United States Patent [19]

Clerc et al.

[11] Patent Number: 5,032,832

[45] Date of Patent: Jul. 16, 1991

[54] METHOD TO CONTROL A MATRIX DISPLAY SCREEN AND DEVICE FOR IMPLEMENTATION OF SAID METHOD

[75] Inventors: Jean-Frédéric Clerc, Machida, Japan; Denis Sarrasin, Rives, France

[73] Assignee: Commissariat A L'Energie Atomique, Paris, France

[21] Appl. No.: 310,340

[22] Filed: Feb. 14, 1989

[30] Foreign Application Priority Data

Feb. 15, 1988 [FR] France ..... 88 01741

[51] Int. Cl.[5] ..... G09G 3/34

[52] U.S. Cl. ..... 340/805; 340/811

[58] Field of Search ..... 340/765, 784, 805, 811, 340/812, 813; 350/332, 333; 358/230, 236

[56] References Cited

U.S. PATENT DOCUMENTS 4,044,346 8/1977 Akahane et al. .
4,476,466 10/1984 Mitani et al. ..... 340/811
4,625,204 11/1986 Clerc ..... 340/805
4,626,072 12/1986 Clerc et al. ..... 340/718
4,724,433 2/1988 Inoue et al. ..... 340/805
4,841,294 6/1989 Clerc ..... 340/805

FOREIGN PATENT DOCUMENTS 0197742 10/1986 European Pat. Off. .
0206178 12/1986 European Pat. Off. .
3401073 7/1984 Fed. Rep. of Germany .
2623013 11/1987 France .

*Primary Examiner*—Jeffery A. Brier
*Attorney, Agent, or Firm*—Oblon, Spivak, McClelland, Maier & Neustadt

[57] ABSTRACT

Method for controlling a matrix display screen enabling its contrast to be adjusted as regards a liquid crystals screen and its luminosity as regards a fluorescent micropoints screen, said method consisting of periodically applying line conductors addressing signals V1 having for a certain period a value Vmax into an absolute value to be applied to column conductors of control signals. Addressing signals are applied to the line conductors, the durations of said signals having a value Vmax and are partially recovered for two consecutive lines.

3 Claims, 3 Drawing Sheets

FIG.1a PRIOR ART
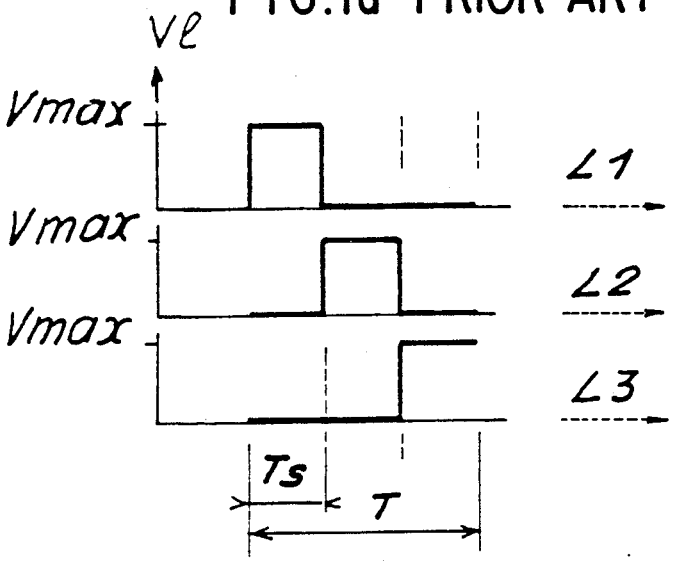
FIG.1c
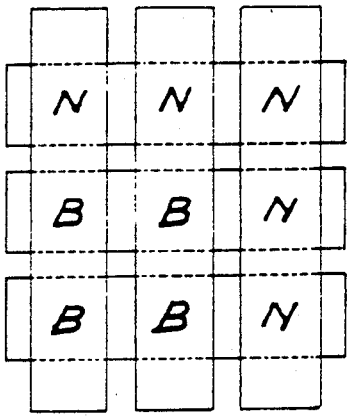
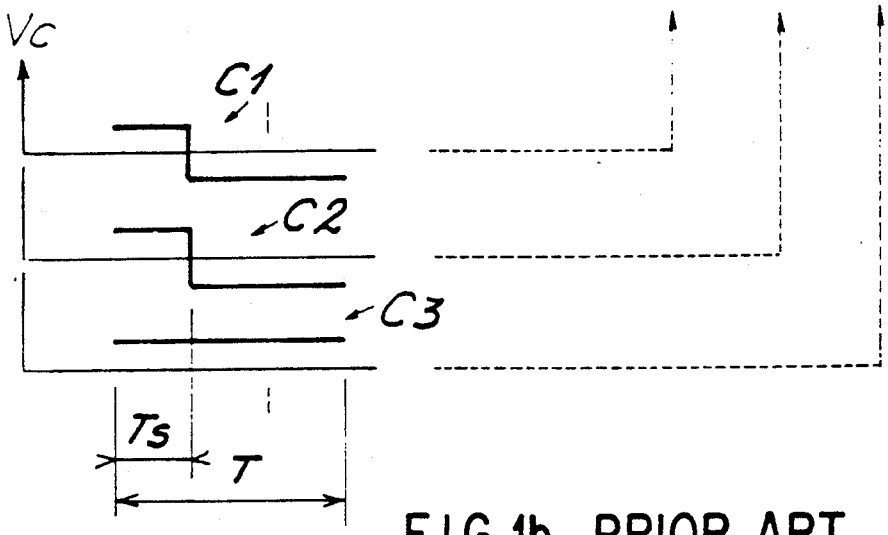
FIG.1b PRIOR ART
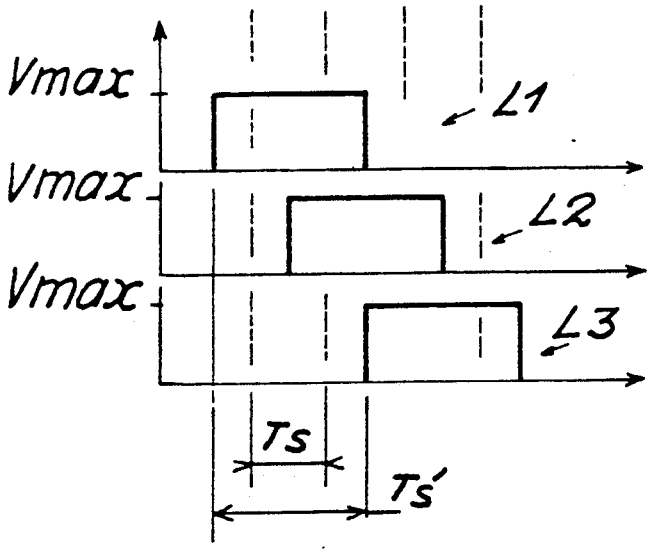
FIG. 2

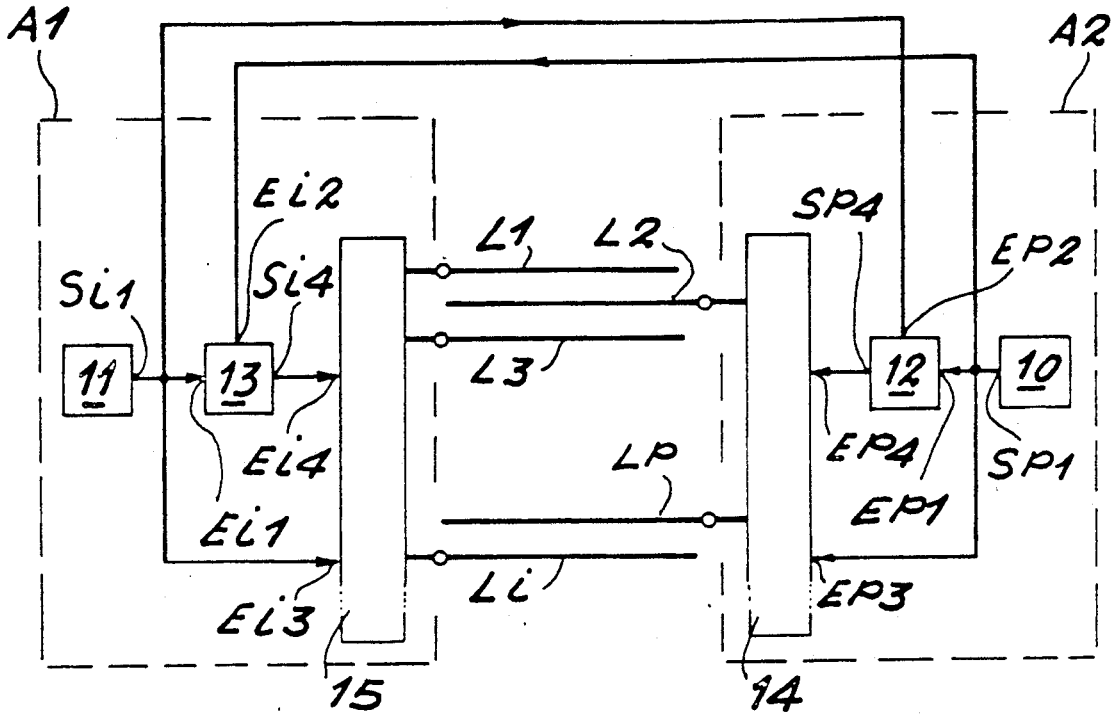
FIG. 3
FIG. 4
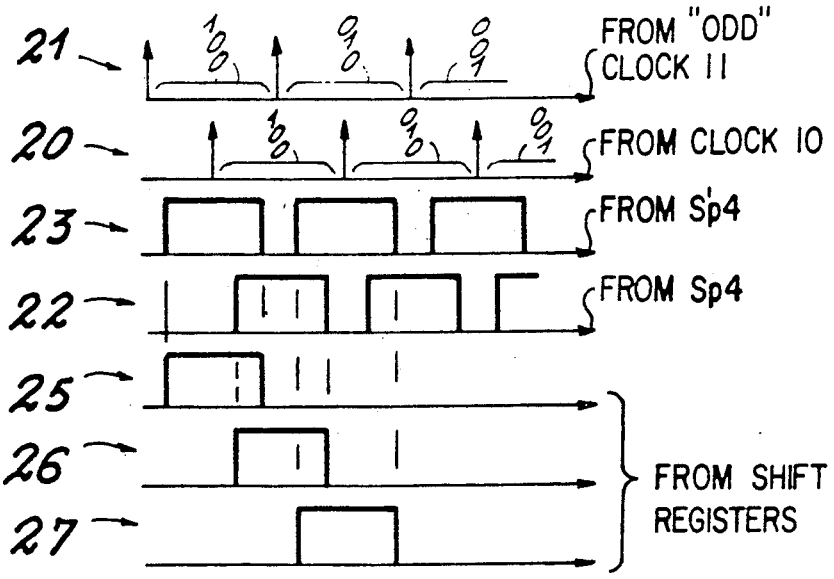

METHOD TO CONTROL A MATRIX DISPLAY SCREEN AND DEVICE FOR IMPLEMENTATION OF SAID METHOD

FIELD OF THE INVENTION

The object of the present invention relates to a method to control a matrix display screen enabling its contrast to be adjusted as regards a liquid crystals screen and its luminosity as regards a fluorescent micropoints screen and a device for the implementation of this method.

BACKGROUND OF THE INVENTION

In particular, the invention applies to the embodiment of liquid crystals indicators of the multiplexed type or of the non-multiplexed type or even fluorescent micropoint screens (marked FMS in the continuation of the description) allowing for the display of fixed or animated images.

Various known types of methods exist for controlling matrix display screens.

Matrix display screens comprise a display cell provided with line conductors and crosswise column conductors, one pixel of the screen being associated with each crossing of these conductors.

One description of such an FMS appears in the French patent application No. 87 15432 of the 6th Nov. 1987. In one FMS, the lines correspond to the grids and the columns to the cathodes.

As regards liquid crystal screens, the display material is contained in the display cell. Liquid crystal screens may be multipexed or non-multiplexed controlled.

In more detail and relating to a multiplexed display screen, the line conductors and columns are constituted by column and line electrodes respectively disposed on the internal walls of the cell, one pixel being defined by the zone for overlapping one line electrode and one column electrode.

In the case of a non-multiplexed display screen, the line and column conductors are constituted by addressing lines and control columns which, for example, are disposed on one of the walls of the cell and connected by means of transistors to point electrodes, one d.c. electrode being disposed on the other wall of the cell. According to a further example of this type of screen, the addressing lines and the control columns may be respectively disposed on the internal walls of the cell, the lines being connected by means of transistors to point electrodes and the columns being connected to electrode columns. In these last two cases, one pixel is defined by the zone for overlapping one point electrode with the d.c. electrode or with one column electrode.

Addressing signals are sent onto the various line conductors and control signals are sent onto the column conductors. One example, given by way of illustration and being in no way restrictive, is shown on FIG. 1 and describes such signals where a matrix liquid crystals display screen is controlled by the technique known as the direct multiplexing technique.

For reasons of simplicity and in no way altering the above-mentioned description, this technique is limited in this example to one screen having nine pixels, namely three line conductors L1, L2, L3, and three column conductors C1, C2, C3.

The voltages V1 applied to the line conductors are periodical with a period T known as a frame time or scanning time. For each line conductor, the voltage V1 is equal to a voltage Vmax for a time Ts, known as a line selection time, and is nil, for example, outside this time Ts concerning the rest of the time T. Each line is thus brought successively during a time Ts up to the value Vmax. FIG. 1A shows an addressing cycle of the line conductors. FIG. 1B describes a sequence example of the control voltages Vc applied to the column conductors. Depending on the motif to be displayed, the voltages applied to the column conductors shall be positive or negative.

The values of the voltages applied to the line conductors and column conductors depend on the type of display used.

When the voltage applied to a line conductor is in phase with the voltage applied to a column conductor, the pixel corresponding to their crossing is extinguished (black, for example). If the two voltages are in opposition of phase, the pixel in question is lit up (white, for example).

When the line L1 is otherwise selected when it is brought to Vmax during Ts, the voltage on the column C1 is positive in the example in question. The two column and line voltages are in phase and the pixel corresponding to the crossing of the line conductor L1 with the column conductor C1 is black. When the line L2 is selected, the voltage on the column C1 is negative in the example in question. The two line and column voltages are in opposition of phase and the pixel corresponding to the crossing of the line conductor L2 with the column conductor C1 is white. The state of each pixel is deduced identically.

FIG. 1C gives the display of the screen for the proposed line and column voltages on FIGS. 1A and 1B. The pixels marked N are black and those marked B are white.

For the display of given information and to each corresponding period T, the line and column voltages have their polarity inverted so as to only apply to the display material signals of nil average values.

In the case of a non-multiplexed liquid crystals type screen or an FMS, the selection signals of the line conductors are the same as those shown on FIG. 1A, but they do not undergo any polarity inversion. On the other hand, the signals applied to the column conductors may be either of negative or positive polarity, their amplitude solely depending on the voltage required with the electro-optical effect used.

In all cases, the line selection time Ts depends on the number of line conductors to be selected by the formula Ts=T/M where M is the total number of line conductors and T is the frame time. It is understood that M increases more when the selection time Ts is shorter.

The multipexing rate TM is defined as being the ratio between the frame time T and the selection time Ts of one line conductor.

$$TM = T/Ts$$

For the known screens, TM=M is established.

When the number of line conductors increases, the multiplexing rate follows this growth and the time Ts diminishes resulting in a reduction of the contrast of a liquid crystals screen and the luminosity of an FMS.

The number of lines currently used in matrix display screens with liquid crystals is about one hundred. Thus, this number is considerably lower than the number of available video line signals which is equal, for example, to about two hundred and eighty at the output of a video recorder.

SUMMARY OF THE INVENTION

The invention proposes a method for controlling a matrix display screen which allows for the use of a large number of lines without resulting in any loss of contrast or luminosity or, with a number of lines equal to those of screens of the prior Art, of even improving contrast or luminosity.

This improvement may not be interpreted independently of phenomena linked to the physiology of the eye; it corresponds to an average effect of the information contained on the screen concerning a frame time.

In this method, the selection time of the adjacent line conductors may be overlapped. Overlapping adjustment makes it possible to use a screen in a graphic or text mode or in video mode for displaying an animated image. In the first case, overlapping must be nil or low; contrast or luminosity are limited, but effective resolution is then maximum. In the second case of use, the high number of lines avoids a mosaic appearance on the screen, this proving to be disagreeable to the eye. Overlapping may extend as far as half the selection times of two adjacent lines to obtain strong contrast or luminosity. Effective resolution is then reduced, but this does not adversely affect an animated image (natural image).

By means of this method, if reference is made to the example relating to the prior Art, the multiplexing rate TM is now less than or equal to the number of line conductors. At this equal multiplexing rate, it is possible to therefore increase the number of line conductors and thus improve the contrast or luminosity of the screen.

More precisely, the object of the invention is to provide a method for controlling a matrix display screen comprising line conductors and column conductors, this method consisting of:

applying periodically to the line conductors addressing signals V1 having for a certain period a value Vmax as an absolute value, applying control signals to the column conductors, this method being characterized that addressing signals are applied to the line conductors, the periods of said signals having a value Vmax and are partially overlapped for two consecutive lines.

According to another characteristic of this control method, the period, whose addressing signals V1 have a value Vmax, is adjustable.

A further object of the invention is to provide a device for implementing the method for controlling a display screen. This device includes:

an addressing circuit A1 connected by means of connections to the line conductors Li, i being an odd whole number so that $1 \leqq i \leqq M$, M being the number of line conductors, an addressing circuit A2 connected by connections to the line conductors Lp, p being an even whole number so that $2 \leqq p \leqq M$.

The addressing circuit A2 includes:

a circuit embodying a clock function delivering signals onto an output Sp1, a circuit embodying a locking function connected via one input Ep1 to the output Sp1 of the circuit embodying the clock function and delivering signals onto an output Sp4, a control circuit connected via one input Ep4 to the output Sp4 of the circuit embodying a locking function and via one input Ep3 to the output Sp1 of the circuit embodying a clock function and delivering voltages V1 to the line conductors Lp connected to the circuit.

The adressing circuit A1 has the same structure than the adressing circuit A2. The adressing structure A1 includes:

a circuit embodying a clock function delivering signals onto an output Si1, a circuit embodying a locking function connected via one input Ei1 to the output Si1 of the circuit embodying the clock function and delivering signals onto an output Si4, a control circuit connected via one input Ei4 to the output Si4 of the circuit embodying a locking function and via one input Ei3 to the output Si1 of the circuit embodying a clock function and delivering voltages V1 to the line conductors Li connected to the circuit.

The circuit embodying a locking function in the addressing circuit A2 is also connected via one input Ep2 to one output Si1 of the circuit embodying a clock function in the addressing circuit A1, the circuit embodying a locking function in the addressing circuit A1 being also connected via one input Ei2 to the output Sp1 of the circuit embodying a clock function in the addressing circuit A2.

The control circuits A1 and A2 are, for example, respectively of the shift register type provided with a locking function.

In this way, these control circuits bear the line conductors which are connected to them according to the state of their locking function, namely:

either collectively to a reference potential corresponding to the locking potential;

or selectively according to the logical levels respectively present in the shift registers to the reference potential (state 0) or to the line selection potential (state 1).

This locking function is called in English the "enable" function.

BRIEF DESCRIPTION OF THE DRAWINGS

Other characteristics and advantages of the invention shall appear more readily from a reading of the following description, given purely by way of illustration and being in no way restrictive, with reference to the annexed figures in which:

FIGS. 1A to 1C, already described and relating to the prior Art, illustrate a conventional method for controlling a matrix display screen;

FIG. 2 shows a sequence according to the invention controlling three line conductors where extensive overlapping exists between the selection times;

FIG. 3 shows a device enabling the method according to the invention to be implemented;

FIG. 4 shows the temporal diagrams of the signals delivered by the various elements of a device according to the invention;

DETAILED DESCRIPTION OF THE PREFERRED EMBODIMENTS

Figure 5:
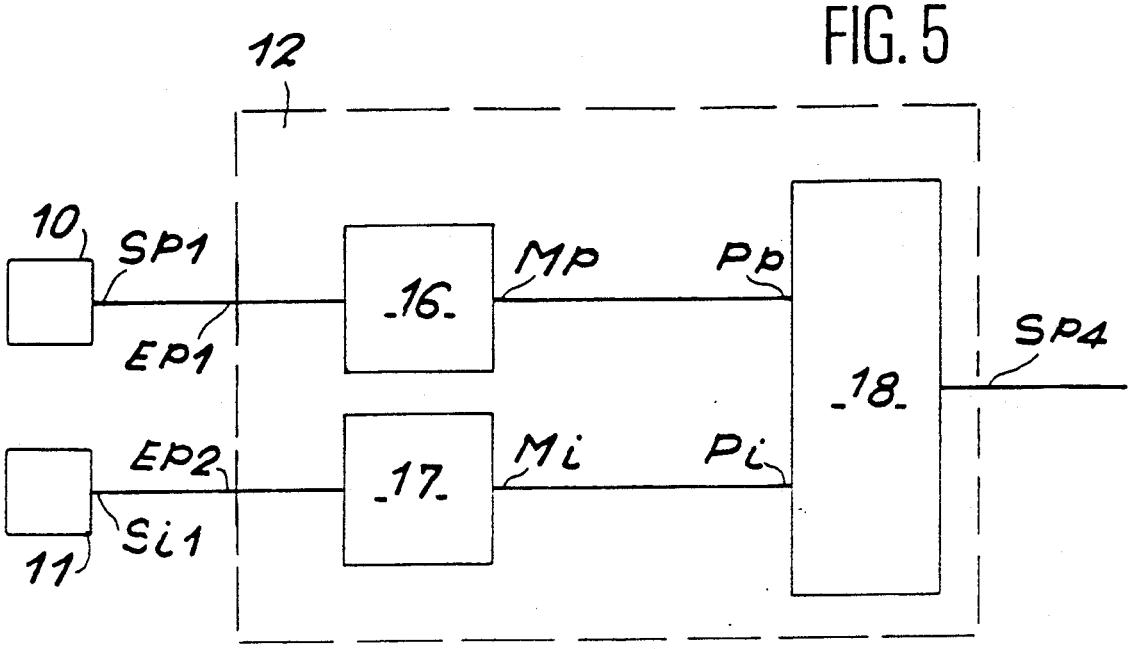
FIG. 5 shows an embodiment example of an "enable" function.

FIG. 2 shows a control sequence according to the invention of three line conductors L1, L2 and L3 where extensive overlapping is required between the selection times. This limit case, where the selection time Ts' is equal to twice the selection time Ts corresponding to a nil overlapping, clearly illustrates the method according to the invention. This example, briefly shown to simply describe the three line conductors, does not in any way limit the number of line conductors possible to select by means of this method. Moreover, this example is also clearly valid for either a multiplexed or a non-multiplexed liquid crystal screen and for an FMS.

The voltage V1 applied to a line conductor is equal during the selection time Ts' to the voltage Vmax and is less than Vmax (it being nil, for example) during the remainder of the frame time.

The total write time for a frame is equal to: $(M \times Ts)+(Ts'-Ts)$.

M is the total number of lines; Ts is the selection time of a line conductor corresponding to a overlapping between the selection times of two nil line conductors; Ts' is the effective selection time of the line conductors. This write time is greater than or equal to a frame time T of the time $Ts'-Ts$, the time $(Ts'-Ts)$ being taken from the time when the video signal does not carry any information, this time being commonly known as the frame return time.

The extension and overlapping of the selection times of the line conductors results in an averaging of the luminous signal from one line conductor to the other. The average brightness of the screen is improved and the contours of the displayed image of the screen are softened.

FIG. 3 shows a device enabling the method according to the invention to be used. The device includes an addressing circuit A1 connected by connections to the line conductors Li, i being an odd whole number so that $1 \leqq i \leqq M$ and an addressing circuit A2 connected by connections to the line conductors Lp, p being an even whole number so that $2 \leqq p \leqq M$. The addressing circuit A2 includes a circuit embodying a clock function delivering signals onto one output Sp1, one circuit 12 embodying an "enable" function connected via one input Ep1 to the output Sp1 of the clock function 10 and delivering signals onto one output Sp4. An "enable" function interlocks the output of the circuit connected to a reference potential (or locking potential), the reference potential being, for example, nil. By this means, the selection time of the line conductors is adjusted. One description of an embodiment of such a function applied to the device according to the invention is provided subsequently in this text. The addressing circuit A2 also includes a control circuit 14 formed by a shift register provided with the even "enable" function connected via an input Ep4 to the output Sp4 of the circuit embodying the "enable" function 12 and via one input Ep3 to the output Sp1 of the circuit embodying the clock function 10 and delivering voltages V1 to the odd numbered line conductors Lp connected to it.

The addressing circuit A1 has a structure identical to the addressing circuit A2. Its connections are allocated to the index letter "i" (odd) instead of the index "p" (even) of the connections of the circuit A2, the circuit embodying the odd clock function 11 having as an even peer the circuit embodying the clock function 10, the circuit embodying the odd "enable" function and the control circuit of the addressing circuit A1 respectively bearing the references 13 and 15 and having as peers the circuits 12 and 14. The control circuit 15 is formed by a shift register provided with the odd "enable" function.

Moreover, the circuit embodying the "enable" function 12 is also connected via one input Ep2 to the output Si1 of the circuit embodying the clock function 11. Similarly, the circuit embodying the "enable" function 13 is connected via one input Ei2 to the output Sp1 of the circuit embodying the even clock function 10.

The temporal diagrams of the signals delivered onto the various outputs of the elements constituting the addressing circuits are shown on FIG. 4.

The signals 20 delivered on the output Sp1 of the circuit embodying the even clock function 10 are shown accompanied by the respective states of the various shift register 14 pockets obtained after each pulse of the even clock signal. The signals 21 are delivered by the odd clock circuit 11 onto the output Si1 of this circuit. These signals are accompanied by the respective states of the various shift register 15 pockets obtained after each pulse of the odd clock signal.

FIG. 4 shows an example illustrating the states of the shift registers delivering voltages V1 onto three even numbered line conductors L2, L4 and L6 and three odd numbered line conductors L1, L3 and L5. On each clock pulse, the state 1, which corresponds to the voltage V1=Vmax at the output of the shift register, advances by one pocket into the register, the state 0 corresponding to, for example, the voltage V1=0V. The even numbered line conductors are successively addressed by applying a voltage V1=Vmax. The same applies to the odd numbered line conductors. The signals 22, 23 are respectively delivered by the outputs Sp4 and Si4 of the odd and even "enable" functions. These are voltages having the form of periodical strobes. For example, the high state of a strobe corresponds to the voltage V1=Vmax and the low state corresponds to the voltage V1=0V. The signals 22 and 23 are dephased, this dephasing being constant: the odd and even lines are alternately addressed.

The signals 25, 26, 27 correspond to the voltages V1 delivered by the shift registers onto the connections of the conductor lines L1, L2 and L3. These are periodical strobes whose period is the frame time.

This control sequence example is given in the case of extensive overlapping between the selection times of the line conductors.

According to the proposed control mode, the circuit A1, which addresses the lines Li, comprises in the register 15 as many logical levels (1 or 0) as there are lines. At each moment, only one of the logical levels is at 1, all the others being at zero. If the logical level 1 is, at the moment in question, associated with the line Li, after a clock strike, it shall be shifted and associated with the line Li+1.

A shift register provided with the interlocking function only selects the line corresponding to the logical level 1, namely in the case in question merely brings this line to the potential Vmax if the "enable" function presents, for example, the high state and does not select any line if the "enable" function presents, for example, the low state. When the "enable" function is in the low state, all the lines are at the locking potential. When the "enable" function is in the high state, one line (associated with the logical level 1 in the shift register) is at the potential Vmax, the other lines (associated with the logical level 0 in the shift register) are at the locking potential. The circuit A2 has the same functioning.

FIG. 5 shows an example of a circuit 12 embodying an "enable" function. This circuit 12 is controlled by the two circuits embodying clock functions 10, 11. The inputs Ep1 and Ep2 of the circuit 12 are respectively connected to the outputs Sp1 and Si1 of the clocks 10 and 11. This example corresponds to the "enable" function forming part of the addressing circuit of the even numbered line conductors. The inputs Ep1 and Ep2 are in fact the respective inputs of two variable capacity monostable circuits 16, 17. The respective outputs Mp, Mi of the two monostable circuits are connected to two inputs Pp, Pi of a logical circuit 18. The output of this circuit 18 is the output Sp4 of the circuit 12 embodying the "enable" function.

Figure 6:
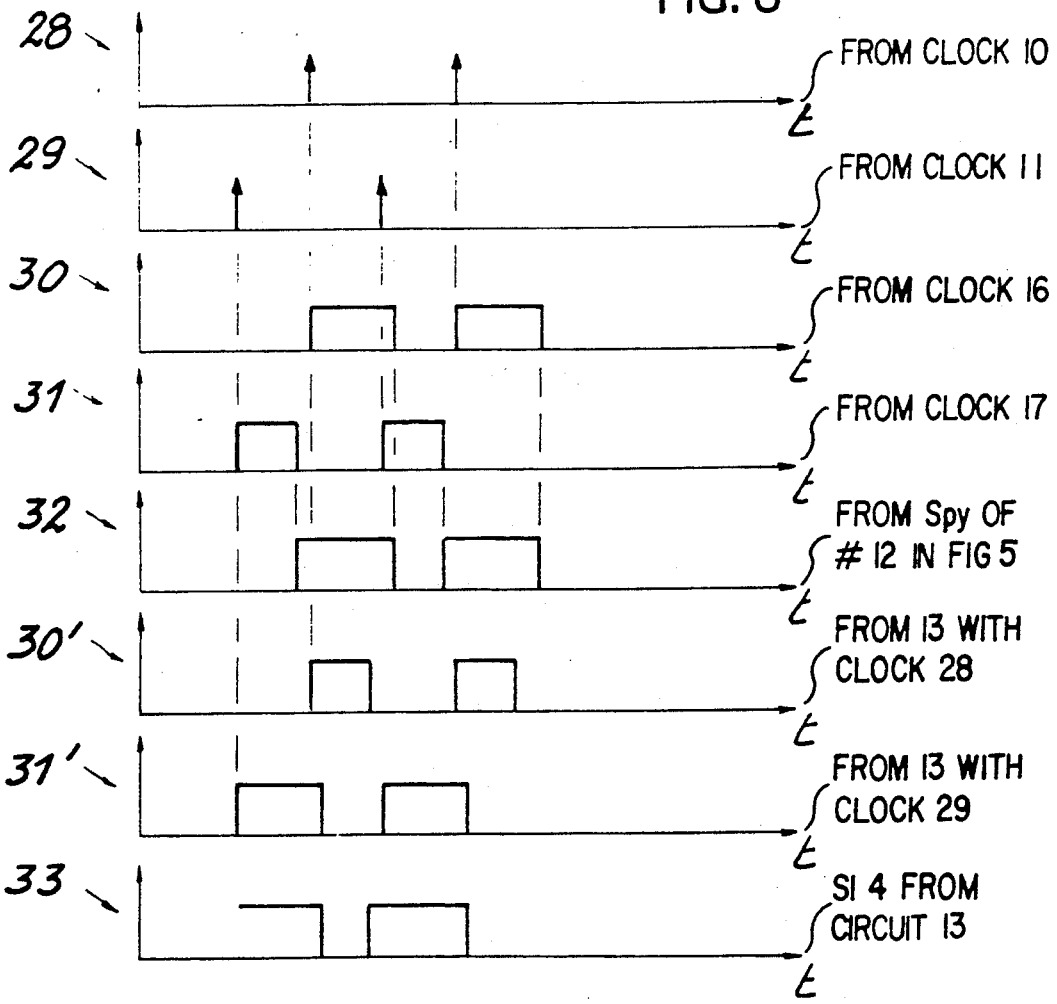
FIG. 6 shows an example of temporal diagrams of the signals delivered by the various elements making it possible to carry out the "enable" functions.

FIG. 6 shows the temporal diagram of the signals derived from the outputs of the various elements allowing the "enable" functions to be embodied.

The clock pulses 28, 29 are the signals delivered by the circuits embodying the clock functions 10, 11 onto the inputs Ep1 and Ep2 of the circuit 12. The variable capacity monostable circuits 16, 17 respectively transform these pulses into rectangular signals 30, 31 whose width depends on the value of their capacity.

The downlead fronts of the rectangular signals 31 control the rise of the rectangular signals 32 delivered onto the output Sp4 of the circuit 12, and the downlead fronts of the rectangular signals 30 control the descent of the rectangular signals 32. Thus, the width of the signals 30, 31 controls the width of the rectangular signals delivered onto the output Sp4. By adjusting the value of the variable capacities of the monostable circuits 16, 17, it is thus possible to decide on the width of the signals delivered onto the output Sp4 and thereby the overlapping time between the selection times of the conductor lines.

The circuit 18 is formed by the entire set of known elements comprising logical gates making it possible to obtain the signals 32 from the signals 30, 31.

The circuit 13 is embodied in the same way as the circuit 12 from two variable capacity monostable circuits and one logical circuit, the inputs of the monostable circuits being respectively connected to the circuits 10 and 11.

The signals 30' and 31' represent an example of the output signals of the monostable circuits of the circuit 13. The signals 30' and 31' are rectangular signals similar to the signals 30, 31 and are obtained from the respective clock pulses 28, 29. The signals 33 represent the resultant rectangular signals obtained on the output Si4 of the circuit 13 by means similar to the means for generating the signals 32 obtained on the output Sp4 of the circuit 12.

These figures show that the overlappings of the selection time of one line with the selection time of the previous line and that of the next line are identical, but of course they may be different. In order to carry out different overlappings, it merely suffices to have odd and even "enable" functions which have rectangular signals of different durations.

What is claimed is:

1. A matrix display screen of the multiplexed type comprising:

line conductors and column conductors, an electrooptic material located between line conductors and column conductors, means for applying control signals to the column conductors, means for applying sequentially to the line conductors addressing signals having a value Vmax as an absolute value during a certain period, the periods when addressing signals have a value Vmax being partially overlapped for two consecutive lines in order to improve the contrast or the luminosity of the screen.

2. A matrix display screen of the multiplexed type according to claim 1, wherein the period is adjustable, when the addressing signals have a value Vmax.

3. A matrix display screen of the multiplexed type according to claim 1 in which said means for applying addressing signals to the line conductors comprise:

an addressing circuit A1 connected by connections to line conductors Li, i being an odd whole number so that $1 \leqq i \leqq M$, M, being the number of line conductors, an addressing circuit A2 connected by connections to line conductors Lp, p being an even whole number so that $2 \leqq p \leqq M$ each addressing circuit comprising:

a clock circuit delivering clock signals onto an output, an interlocking circuit connected by a first input and a second input, respectively, to the outputs of the clock circuits of each addressing circuit, and delivering rectangular signal onto an output, a control circuit connected by an input to the output of the interlocking circuit and by another input to the output of the clock circuit, said control circuit delivering addressing signals onto the line conductors connected to it; and wherein said addressing signals having a Vmax value, as an absolute value, during the period fixed by said rectangular signal, and further wherein periods within which addressing signals delivered by addressing circuits A1, A2 have a Vmax value is partially overlapped for two consecutive lines Lp, Li.

* * * * *